US008598104B2

(12) United States Patent
Kaiser et al.

(10) Patent No.: US 8,598,104 B2
(45) Date of Patent: Dec. 3, 2013

(54) PYRROLIDONE CONTAINING DETERGENT COMPOSITION

(75) Inventors: Roger Kaiser, Ludwigshafen (DE); Jorg Pflug, Ludwigshafen (DE)

(73) Assignee: Reckitt Benckiser N.V., WT Hoofddorp (NL)

( * ) Notice: Subject to any disclaimer, the term of this patent is extended or adjusted under 35 U.S.C. 154(b) by 592 days.

(21) Appl. No.: 12/677,234

(22) PCT Filed: Sep. 12, 2008

(86) PCT No.: PCT/GB2008/003117

§ 371 (c)(1),
(2), (4) Date: Aug. 3, 2010

(87) PCT Pub. No.: WO2009/034355

PCT Pub. Date: Mar. 19, 2009

(65) Prior Publication Data

US 2010/0294310 A1 Nov. 25, 2010

(30) Foreign Application Priority Data

Sep. 14, 2007 (GB) ..... 0717988.0

(51) Int. Cl.
*C11D 3/37* (2006.01)

(52) U.S. Cl.
CPC ..... *C11D 3/378* (2013.01)
USPC ..... 510/220; 510/221; 510/475

(58) Field of Classification Search
USPC ..... 510/220, 221, 475
See application file for complete search history.

(56) References Cited

U.S. PATENT DOCUMENTS 5,308,532 A 5/1994 Adler

FOREIGN PATENT DOCUMENTS

| | | | |
|---|---|---|---|
| DE | 10050622 | A1 | 5/2002 |
| EP | 0806472 | A | 11/1997 |
| EP | 0851022 | A | 7/1998 |
| GB | 2259096 | A | 3/1993 |
| WO | 9217564 | A | 10/1992 |
| WO | 0220708 | A | 3/2002 |
| WO | 03042347 | A | 5/2003 |
| WO | 2004074417 | A1 | 9/2004 |
| WO | 2006106332 | A | 10/2006 |
| WO | 2007052004 | A | 5/2007 |

OTHER PUBLICATIONS

English Language Abstract for DE10050622 taken from esp@cenet.com.
English Language Abstract for EP0806472 taken from esp@cenet.com.

*Primary Examiner* — Gregory Webb
(74) *Attorney, Agent, or Firm* — Norris McLaughlin & Marcus PA

(57) ABSTRACT

A detergent composition comprises a hydrophobic polymer, a sulphonated polyacrylate, a pyrrolidone derivative and an anionic surfactant. The compositions find particular application in dishwashing applications and exhibit reduced tendency for spotting on the articles to be cleaned.

27 Claims, No Drawings

PYRROLIDONE CONTAINING DETERGENT COMPOSITION

This is an application filed under 35 USC 371 of PCT/GB2008/003117.

The invention concerns a detergent composition.

Household detergents are used widely in many applications including laundry care and for hard-surface cleaning such as in an automatic dishwasher. The detergents are commonly available in many product formats including liquids, powders and solids.

It is recognised that a common household detergent is usually made up of a number of different components. One component that is typically present in an automatic dishwasher detergent is a builder.

The builder is used as a chelating agent to aid the removal/capture of metal ions in solution. With their use deposits of metal ion based sediments (such as limescale) within automatic dishwashing machines are reduced and the cleaning process is enhanced (certain stains incorporate a metal ion component, e.g. such as tea stains which comprise a calcium/tannin complex).

Indeed in the absence of a suitable builder poor washing results are usually observed. One highly visible, undesirable characteristic of a poorly-built dishwashing operation is the appearance of 'spotting' on the items being cleaned, such as glassware. Spotting is the occurrence of small spots of limescale on items, believed to occur in the rinse cycle of the washing operation. Since most dishware is usually light in colour/transparent the spots are generally highly visible. However, in addition to this poor aesthetic effect there is also the concern of a poor washing operation.

In the past and up until recently builders based upon phosphate have been used. These have the advantage of being inexpensive, compatible with other detergent components (both in solid and liquid detergent formulations) and washing machines, and widely available. However, one problem with the use of phosphate based builders is that of environmental pollution: excess phosphates in water courses are connected with detrimental environmental effects such as eutrification and excess algal growth, leading to other issues such as a reduction in fish populations.

Consequently the use of phosphates has been legislated against in certain jurisdictions and is being legislated against in further jurisdictions.

The reduction of spotting and minimising phosphate scale formation has been considered by WO02/20708 where it was proposed to use a combination of a hydrophobically modified polycarboxylic acid and a water soluble polymer.

However, there is still a need for alternative builders/chelating agents or for compositions which perform well with reduced levels of phosphates or in the absence of phosphates. In particular there is a need in the art to provide a detergent composition with good resistance against 'spotting' on items being cleaned.

It is an object of the present invention to address at least one of the problems outlined above.

Thus according to a first aspect of the present invention there is provided a detergent composition comprising:—

(a) a hydrophobic polymer, (b) a sulphonated polyacrylate, (c) a pyrrolidone derivative, and (d) anionic surfactant.

Preferably the composition is phosphorus free.

Unless otherwise stated all amounts herein refer to the active concentration in weight (solid content) based on the total weight of the composition.

Compositions in accordance with the present invention have been found to perform excellently, particularly when used in automatic dishwashing operations. In these operations a predominantly beneficial effect is a significant reduction in the appearance of spotting on items being washed in the dishwasher as well as good performance on other stains. These effects are especially surprising for a phosphorus free composition.

Preferably the hydrophobic polymer is present in an amount of from 0.1 to 10 wt %, more preferably from 0.5 to 5 wt, for example 1 to 3 wt % based on the total weight of the composition.

Any suitable hydrophobic polymer may be used according to the invention.

Suitable hydrophobic polymers include sulphonated copolymers which are copolymers of $CH_2{=}CR^1{-}CR^2R^3{-}O{-}C_4H_3R^4{-}SO_3X$ wherein $R^1$, $R^2$, $R^3$, $R^4$ are independently 1 to 6 carbon alkyl or hydrogen, and X is hydrogen or alkali with any suitable other monomer units including modified acrylic, fumaric, maleic, itaconic, aconitic, mesaconic, citraconic and methylenemalonic acid or their salts, maleic anhydride, acrylamide, alkylene, vinylmethyl ether, styrene and any mixtures thereof. Other suitable sulphonated monomers for incorporation in sulphonated (co)polymers are 2-acrylamido-2-methyl-1-propanesulfonic acid, 2-methacrylamido-2-methyl-1-propanesulfonic acid, 3-methacrylamido-2-hydroxy-propanesulfonic acid, allysulfonic acid, methallysulfonic acid, 2-hydroxy-3-(2-propenyloxy)propanesulfonic acid, 2-methyl-2-propenen-1-sulfonic acid, styrenesulfonic acid, vinylsulfonic acid, 3-sulfopropyl acrylate, 3-sulfopropylmethacrylate, sulfomethylacrylamide, sulfomethylmethacrylamide and water soluble salts thereof. Suitable sulphonated hydrophobic polymers for use according to the present invention are also described in U.S. Pat. No. 5,308,532 and in WO 2005/090541.

Preferably the hydrophobic polymer comprises a hydrophobically modified carboxylic acid based polymer, most preferably a hydrophobically modified maleic acid based polymer. The hydrophobically modified carboxylic acid based polymer preferably has a number average molecular weight in the range of from about 8,000 to 15,000, more preferably of from about 9,000 to 12,000, such as from 9,500 to 11,000. A preferred example of such a polymer is Acusol 460 NDP available from Rohm & Haas which is maleic acid based.

Preferably the sulphonated polacrylate is present in an amount of from 0.1 to 10 wt %, more preferably from 1 to 7 wt %, for example 1.5 to 5 wt %.

Suitably the sulphonated polacrylate has a number average molecular weight in the range of from about 8,000 to 15,000 more preferably of from about 10,000 to 14,000, such as from 11,000 to 13,000. A preferred example of such a polymer is Acusol 588 available from Rohm & Haas.

The use of polyvinyl-pyrrolidone as a binder in detergent tablets is know e.g. from WO2006/106332. Also N-alkylpyrrolidone derivatives are known for use in aqueous acidic antimicrobial cleaning compositions (see WO2004/074417).

Preferably the pyrrolidone derivative is present in an amount of from 0.05 to 10 wt %, more preferably from 0.1 to 1.5 wt %, e.g. 0.12 to 0.5 wt %, such as 0.15 to 0.4 wt %.

Preferably the pyrrolidone derivative comprises an alkyl pyrrolidone compound, most preferably an N-alkyl pyrrolidone compound. An especially preferred example of such a compound is N-(n-octyl)-2-pyrrolidone.

It has been found according to the invention that when the pyrrolidone derivative is used in combination with an anionic surfactant especially good results are obtained with respect to the reduction of spotting on items washed with the compositions in a dishwasher. Accordingly, the composition also comprises an anionic surfactant. The pyrrolidone derivative and the anionic surfactant may be added as separate components to the composition or they may be added as a pre-combined mixture. Preferred anionic surfactants are sulphate surfactants and in particular alkyl ester sulphates, especially $C_9$-$C_{16}$ ester sulphates and most especially $C_{10}$-$C_{14}$ ester sulphates, such as mono dodecyl ester sulphates. It is preferred that the sodium salts of these surfactants are used, although any suitable salts may be used.

A preferred example of such a pyrrolidone derivative/anionic surfactant mixture is Easy-Wet® 20 available from ISP, which is an aqueous mixture of 15-25 wt % N-(n-octyl)-2-pyrrolidone and 1-2 wt % of the sodium salt of sulphuric acid monododecyl ester.

Typically the anionic surfactant is present in an amount of from 0.005 to 1.5 wt %, more preferably 0.01 to 0.5 wt %, such as 0.02 to 0.2 wt %. According to the invention it is preferred that the compositions comprise 0.005 to 1.5 wt % alkyl ether sulphate.

Generally the detergent composition comprises a builder. Usually the builder is present in an amount of from 0.1 to 80 wt %, more preferably from 25 to 35 wt %.

Preferably the builder comprises a non-phosphorous based builder. It is especially preferred that the non-phosphorous based builder is present in an amount of from 1 to 80 wt % more preferably from 25 to 35 wt %.

Suitable examples of non-phosphorous based builders are amino carboxylate based builders and include methyl glycine diacetic acid (MGDA) and/or glutamic-N,N-diacetic acid (GLDA) and/or salts thereof.

The detergent composition may be in the form of a powder, a compressed particulate body, an injection moulded body or a liquid/gel. Most preferably the composition is in the form of a liquid/gel. Typically liquid/gel compositions according to the invention comprise water in am amount of from 30-70 wt %, more preferably 40-65 wt %, most preferably 50-60 wt %. The detergent composition may be packaged in a water soluble material such as a water soluble film, e.g. polyvinyl alcohol.

The composition may further incorporate auxiliary materials, such as the usual detergent additives or fillers, e.g. one or more of the following agents; bleach, corrosion inhibition agent, fragrance, co-builder, surfactant, binding agent, dye, acidity modifying agent, dispersion aid, or enzyme.

Preferably the detergent composition of the invention is for use as an automatic detergent composition/additive and most preferably as an automatic dishwashing composition/additive.

According to a second aspect of the invention there is provided the use of a composition comprising:—

(a) a hydrophobic polymer,
(b) a sulphonated polyacrylate,
(c) a pyrrolidone derivative, and
(d) non-ionic surfactant in an automatic dishwashing process.

Accordingly, the compositions of the invention find particular application in dishwashing applications.

The invention will now be further described with reference to the examples. Further examples within the scope of the present invention will be apparent to the person skilled in the art.

EXAMPLES

Example 1

A formulation having the following composition was prepared.

| Raw material | [wt %] |
|---|---|
| Water | 58.58 |
| Preservative | 0.30 |
| Calcium chloride dehydrate | 0.08 |
| Zinc sulfate hexahydrate | 0.32 |
| Xantham Gum | 0.50 |
| Dye | 0.03 |
| Nonionic surfactant (Plurafac(RTM) LF 4030) *1 | 1.50 |
| Tetrasodium GLDA | 31.00 |
| Amylase | 0.40 |
| Protease | 2.00 |
| hydrophobic polymer *2 | 2.30 |
| pyrrolidone derivative/anionic Surfactant mixture *3 | 0.21 |
| Sulphonated polyacrylate *4 | 2.48 |
| Perfume | 0.30 |
| | 100.00 |

*1 fatty alcohol alkoxylate non-ionic surfactant available from BASF, Germany.
*2 hydrophobically modified maleic acid based polymer with a number average molecular weight of about 10,000 available from Rohm & Haas as Acusol(RTM) 460 NDP.
*3 a mixture of 15-25 wt % N-(n-octyl)-2-pyrrolidone and 1-2 wt % sodium monododecyl ester sulphate, available from ISP as Easy-Wet(RTM) 20.
*4 available from Rohm & Haas as Acusol(RTM) 588, having a molecular weight of about 12,000.

Example 1 was tested against a commercially available phosphorous-containing composition in an automatic dishwashing process. Both compositions were tested using a water soluble sachet containing a specified amount (see table) of a liquid composition.

For the testing conditions a GE GSD4800J01WW machine was used and operated under a normal wash/heated dry program. The water used in the machine had a hardness of 160-180 ppm and a temperature of 49° C. No rinse aid was used and the results were assessed using the following criteria after 5 washing cycles:—

Filming: Scores 1-5 (5=heavy filming; 1=no filming)

Spotting: Scores 1-5 (5=completely covered; 1=no spots)

| | Product | |
|---|---|---|
| | Commercially Available Phosphorus Containing composition (24.3 g) | Example 1 (21.5 g) |
| Spotting | 3.8 | 3.0 |
| Filming | 1.7 | 1.8 |

The inventive composition shows a better spotting performance and comparable filming performance to a commercially available phosphorous containing composition.

Example 2

A formulation in accordance with the invention (Example 1) was tested against a commercially available phosphorous containing composition in an automatic dishwashing process. Both compositions were tested using a water soluble sachet containing an amount (see table) of a liquid composition.

For the testing conditions a GE GSD4800J01WW machine was used and operated under a normal wash/heated dry program. The water used in the machine had a hardness of 9° dH and a temperature of 49° C. No rinse aid was used and the results were assessed using the numerous criteria after 4 washing cycles.

| | Product | | | |
|---|---|---|---|---|
| | Commercially Available Phosphorus Containing (24.3 g) | | Example 1 (21.5 g) | |
| | | ± | | ± |
| Bleachable stains | 4.3 | | 4.4 | |
| TEA | 4.3 | 0.29 | 4.4 | 0.25 |
| Starch, dried-on | 9.4 | | 9.7 | |
| OAT FLAKES | 9.0 | — | 9.5 | 0.20 |
| STARCH MIX (200 mg) | 9.8 | 0.12 | 9.9 | 0.12 |
| Protein, dried-on | 7.7 | | 7.4 | |
| MINCED MEAT | 10.0 | — | 9.9 | 0.25 |
| EGG YOLK | 5.7 | 0.40 | 5.2 | 0.34 |
| EGG YOLK/MILK | 7.4 | 0.45 | 7.1 | 0.21 |
| Burnt-on Stains | 7.1 | | 7.1 | |
| MILK | 7.1 | 0.10 | 7.1 | 0.29 |
| Average | 7.1 | | 7.1 | |

The composition in accordance with the invention shows comparable performance across a broad spectrum of stains when compared against a commercially available phosphorus containing composition.

The invention claimed is:

1. A detergent composition comprising:

(a) a hydrophobic polymer, (b) a sulphonated polyacrylate, (c) a pyrrolidone derivative, (d) anionic surfactant, and, (e) a non-phosphorus based builder which comprises methyl glycine diacetic acid and/or glutamic-N,N-diacetic acid and/or salts thereof.

2. A detergent composition according to claim 1, wherein the hydrophobic polymer is present in an amount of from 0.1 to 10 wt %.

3. A detergent composition according to claim 1, wherein the sulphonated polyacrylate is present in an amount of from 0.1 to 10 wt %.

4. A detergent composition according to claim 1, wherein the sulphonated polyacrylate has a number average molecular weight in the range of from about 8,000 to about 15,000.

5. A detergent composition according to claim 1, wherein the pyrrolidone derivative is present in an amount of from 0.05 to 10 wt %.

6. A detergent composition according to claim 1, wherein the pyrrolidone derivative comprises an alkyl pyrrolidone compound.

7. A detergent composition according to claim 6, wherein the pyrrolidone derivative comprises an N-alkyl pyrrolidone compound.

8. A detergent composition according to claim 7, wherein the N-alkyl pyrrolidone compound comprises N-(n-octyl)-2-pyrrolidone.

9. A detergent composition according to claim 1, wherein the anionic surfactant comprises an alkyl ester sulphate.

10. A detergent composition according to claim 1, wherein the composition comprises 0.005 to 1.5 wt % anionic surfactant.

11. A detergent composition according to claim 1, wherein the composition comprises 0.005 to 1.5 wt % alkyl ester sulphate and an N-alkyl pyrrolidone compound.

12. A detergent composition according to claim 1, wherein the non-phosphorous based builder is present in an amount of from 0.1 to 80 wt %.

13. A detergent composition according to claim 1 wherein the composition is a dishwashing composition.

14. A method of cleaning dishware in an automatic dishwashing process, the method comprising the step of: providing a dishwashing composition according to claim 13 to an automatic dishwasher during an automatic dishwashing process.

15. A detergent composition according to claim 1, wherein the hydrophobic polymer comprises a hydrophobically modified carboxylic acid based polymer.

16. A detergent composition according to claim 15, wherein the hydrophobic polymer is a hydrophobically modified maleic acid based polymer.

17. A detergent composition according to claim 1, wherein the hydrophobic polymer has a number average molecular weight in the range of from 8,000 to 15,000.

18. A detergent composition according to claim 1, which is a liquid or gel composition.

19. A detergent composition according to claim 18, which comprises 30-70 wt % water.

20. A detergent composition according to claim 1, packaged in a water soluble film material.

21. A liquid or gel detergent composition comprising:

(a) a hydrophobic polymer, (b) a sulphonated polyacrylate, (c) an alkyl pyrrolidone, and (d) an anionic surfactant;

wherein ingredients (a) to (d) are all different.

22. A detergent composition according to claim 21, which comprises 30-70 wt % water.

23. A detergent composition according to claim 21, which is an automatic dishwashing detergent composition.

24. A detergent composition according to claim 21, wherein the said composition is phosphate-free.

25. A detergent composition comprising:—

(a) a hydrophobic polymer, (b) a sulphonated polyacrylate, (c) an alkyl pyrrolidone, and (d) an anionic surfactant.

26. A detergent composition according to claim 25, wherein the alkyl pyrrolidone is N-(n-octyl)-2-pyrrolidone.

27. A detergent composition according to claim 25, wherein the said composition is phosphate-free.

* * * * *